US009543669B2

(12) United States Patent
Broughton et al.

(10) Patent No.: US 9,543,669 B2
(45) Date of Patent: Jan. 10, 2017

(54) SUPPORTED TERMINATION

(71) Applicant: ROLLS-ROYCE plc, London (GB)

(72) Inventors: Paul Broughton, Leicester (GB); Richard Peace, Derby (GB)

(73) Assignee: ROLLS-ROYCE PLC, London (GB)

( * ) Notice: Subject to any disclaimer, the term of this patent is extended or adjusted under 35 U.S.C. 154(b) by 0 days.

(21) Appl. No.: 14/953,148

(22) Filed: Nov. 27, 2015

(65) Prior Publication Data

US 2016/0156112 A1 Jun. 2, 2016

(30) Foreign Application Priority Data

Dec. 1, 2014 (GB) ..... 1421264.1

(51) Int. Cl.

| | |
|---|---|
| ***H01R 4/70*** | (2006.01) |
| ***H01R 4/30*** | (2006.01) |
| ***H01R 4/34*** | (2006.01) |
| ***H01R 9/22*** | (2006.01) |
| ***H01R 13/447*** | (2006.01) |
| ***H01R 13/52*** | (2006.01) |
| ***H01R 13/533*** | (2006.01) |
| *H01R 11/12* | (2006.01) |

(52) U.S. Cl.

CPC *H01R 4/70* (2013.01); *H01R 4/30* (2013.01); *H01R 4/34* (2013.01); *H01R 9/22* (2013.01); *H01R 13/447* (2013.01); *H01R 13/5213* (2013.01); *H01R 13/533* (2013.01); *H01R 11/12* (2013.01)

(58) Field of Classification Search

CPC ..... H01R 9/223; H01R 9/2416; H01R 9/24
USPC ..... 439/718, 709, 801, 712
See application file for complete search history.

(56) References Cited

U.S. PATENT DOCUMENTS

| | | | | |
|---|---|---|---|---|
| 2,403,979 A * | 7/1946 | Hill | ..... | H01R 31/00 439/718 |
| 2,983,897 A * | 5/1961 | Blanchet | ..... | H01R 9/26 439/716 |
| 3,049,582 A | 8/1962 | Shinn | | |
| 3,715,459 A | 2/1973 | Hoffman | | |

(Continued)

FOREIGN PATENT DOCUMENTS

DE 10 2013 007 036 A1 10/2014

OTHER PUBLICATIONS

Mar. 29, 2016 Search Report issued in European Patent Application No. 15 19 6639.

(Continued)

*Primary Examiner* — Gary Paumen
(74) *Attorney, Agent, or Firm* — Oliff PLC

(57) ABSTRACT

The present invention relates to an assembly for the improved connection or termination of one or more minerally insulated cables, the assembly comprising an electrically insulating plate comprising one or more channels to accommodate and support one or more inward cables; one or more channels to accommodate and support one or more outward cables; one or more recesses to accommodate one or more electrical components; one or more terminal studs arranged to connect said at least one inward and outward cable; and a protective cover comprising one or more protective plates locatable over the electrically insulating plate and cables and further comprising one or more recesses located so as to provide access to each of the one or more terminal studs.

15 Claims, 4 Drawing Sheets

(56) References Cited

U.S. PATENT DOCUMENTS

| | | | | |
|---|---|---|---|---|
| 4,316,471 | A | 2/1982 | Shipko et al. | |
| 4,345,806 | A * | 8/1982 | McHenney | H01R 4/30 439/510 |
| 4,410,226 | A | 10/1983 | Adduci et al. | |
| 4,483,910 | A | 11/1984 | Julian | |
| 5,147,219 | A | 9/1992 | Gilberts et al. | |
| 5,203,724 | A * | 4/1993 | Casey | H01R 9/24 439/521 |
| 6,630,626 | B2 * | 10/2003 | Johnson | H01R 13/447 174/138 F |
| 8,465,331 | B2 * | 6/2013 | Shimowake | H01R 9/24 439/709 |
| 2003/0003811 | A1 * | 1/2003 | Chadbourne | H01R 9/2408 439/718 |
| 2006/0228950 | A1 | 10/2006 | Jamaleddin et al. | |
| 2012/0049672 | A1 * | 3/2012 | Grosskopf | H01R 9/223 310/71 |
| 2013/0072047 | A1 | 3/2013 | Opper et al. | |

OTHER PUBLICATIONS

May 19, 2015 Search Report issued in British Patent Application No. 1421264.1.

* cited by examiner

SUPPORTED TERMINATION

FIELD OF THE INVENTION

The present invention relates to an apparatus for providing an improved assembly for the electrical connection or termination of one or more cables. In particular, it relates to an apparatus and method for connecting or terminating a minerally insulated cable whilst providing improved reliability and damage resistance.

BACKGROUND OF THE INVENTION

In the case of a typical connector and/or terminal for electrical applications, shaped conductors such as terminal tags are often clamped to a standard wire. As such, it is typical for connectors and terminals to use multiple connecting methods within a given assembly. Such methods typically include one or more of mechanical and/or electrical connecting means, wherein connectors or terminals project from an article for subsequent electrical connection. Accordingly, terminal tags provide a traditional means of mechanical and/or electrical connection.

Most typically, wires are mechanically and/or electrically connected to terminal tags via soldering or crimping methods to provide a mechanical and electrical contact. As such, the terminal tags are shaped, for example, at one end to mechanically and electrically receive and prevent the withdrawal of a wire, whilst being shaped at the opposing end for mechanical and electrical interaction with a terminal or connection point. In use, the tag ensures that the wire is electrically connected to the connector and/or terminal via a means which is of increased reliability than via direct attachment of the wire. Thus, through insertion of the female portion of the terminal tag into the male portion of the connector and/or terminal, a reliable electrical contact may be established.

In high temperature electrical applications, it is most typical for "Minerally Insulated" cable, also known as MI cable, to be used. Therein, a flexible metal tube/casing is typically filled with one or more wires, the wires of which are often prevented from coming into contact with both each other and the casing by filing the tube with a mineral powder to provide both an electrical- and heat-insulating portion. In particular, the incorporation of a heat-insulating portion makes MI cable particularly suitable for use in high-temperature environments or applications.

Of particular difficulty when using MI cable is connection and termination of the cable within a given electrical system. In particular, pot seals are known as a viable means for both connecting and terminating MI cable. It is most typical for MI cable to be fed into a casing, which is most typically metal and thereby referred to as a pot. However, MI cable is notoriously difficult to terminate and/or connect to other components using these methods, and these terminations are easily damaged, rendering the connections unreliable. When using MI cable in a high temperature attachment, and wherein there exists a need to terminate and/or connect electrical applications, a pot seal may be used in conjunction with a terminal tag in order to provide a sufficient mechanical and/or electrical connection. It may also be required that the MI cable be subsequently welded, braised or soldered to the terminal tag in order to provide additional strength and or connectivity.

In particular, it is well known that MI cable is notoriously difficult to terminate and/or connect whilst maintaining resistance to high temperature operating environments. In this regard, it will be appreciated that connecting or terminating MI cable in a high temperature environment exposes the delicate internal cabling to high temperatures, thus removing the benefit of the insulating portion. Furthermore, it is known that MI cable is notoriously prone to damage due to its brittle nature. In particular, damage often occurs to exposed MI cabling and/or pot seals through external interaction. For example, damage may occur through articles being dropped on to the cabling or terminating/connecting means or, for example, through differential vibration within the structure.

It would therefore be advantageous to provide an improved connector suitable for the connection or termination of MI cable without the aforementioned disadvantages.

SUMMARY OF THE INVENTION

The present invention accordingly provides, in a first aspect, an insulating connector for the connection of two or more cables or wires, the assembly comprising an electrically insulating block, said block comprising one or more channels to accommodate and support one or more inward cables; one or more channels to accommodate and support one or more outward cables; one or more recesses to accommodate one or more electrical components; one or more terminal studs, each stud arranged to connect said at least one inward and outward cable; and, a cover, the cover comprising one or more protective plates locatable over the electrically insulating block and cables, the protective plates further comprising one or more recesses located so as to provide access to each of the one or more terminal studs.

Thus, in this way, the present invention provides an improved arrangement for the termination or connection of two or more minerally insulated (MI), insulated or non-insulated cable and/or wire, or any combination of the same, which provides improved reliability and damage resistance over connection means currently comprised within the art. Thus, in this way, the present invention provides a design of increased robustness and reliability through the pot seal and MI cable being positively held in to remove strain on the MI/Pot Seal junction, whilst shielding the connection means from foreign object interaction and/or impact associated damage.

Optionally, one or more of the protective plates may be comprised of an electrically insulating material.

Thus, in this way, the present invention provides a means for the electrical isolation from the substrate and/or a further insulating plate between the substrate and the further component as required.

Optionally, one or more of the protective plates are of increased toughness relative to the protective cover and/or electrically insulating block.

Thus, in this way, the one or more protective plates may be shatter resistant so as to maintain structural rigidity or integrity during instances of instantaneous or continuously applied stress and/or strain. Such instances may include tools being dropped onto the electrical connector or a catching of the cable on any further component during for example, fitment, service or overhaul of the gas turbine engine.

Optionally, one or more of the protective plates may comprise a lid which is fixedly attached to a substrate.

Thus, in this way, the present invention provides a means for protecting the terminal tag, pot seal, cables and/or wires, or any further means of connection from external interaction, such as, for example, operator induced or accidental damage.

Optionally, the lid may comprise a recess or cavity.

Thus, in this way, an operator may access predetermined areas upon the connector assembly without necessarily needing to dismantle the connector. Such access may be advantageous in instances where it is necessary to test the connection or termination of the cable.

Optionally, the recess or cavity may be placed so as to allow access to each of the one or more terminal studs.

Optionally, said inward or outward cable may be bifurcated within a pot seal, said pot seal being contained within a recess formed within the electrically insulating block.

Optionally, said inward or outward bifurcated cable may thereon be connected to one or more inward or outward conductors protruding from said pot seal.

Optionally, said inward or outward conductors may be connected to said one or more terminal studs by one or more connection terminals.

Optionally, said connection terminals may be comprised of ring tags, said ring tags being arranged so that they may locate, in use, on respective terminal studs.

Optionally, the slot width of each channel comprised within the insulating block may be approximately equal to or greater than the diameter of the cable to be located, in use, in each respective channel.

Optionally, the slot width of each recess comprised within the insulating block varies to accommodate, in use, the respective pot seals, conductors, connection terminals and ring tag components.

Optionally, said one or more inward cables may be supported before entry into the assembly by a cable location and support feature.

Optionally, said one or more outward cables may be supported following exit from the assembly by one or more cable location and support features.

Optionally, the electrically insulating block may comprise at least a sufficient number of channels and/or recesses to accommodate, in use, each cable and electrical component.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENTS

Figure 1:
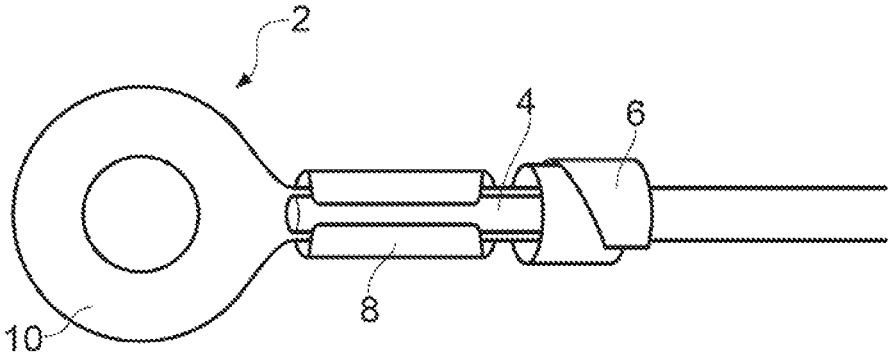
FIG. 1 (Prior Art)
FIG. 1 shows a terminal tag clamped to a wire or cable.

FIG. 1 shows a terminal tag 2 clamped to a wire 4, the terminal tag 2 being most typically used for standard cabling and/or wires 4. The arrangement shown includes both mechanical and electrical connecting means via a mechanical crimped joint 6 for the purpose of providing additional support to the tag, and an electrical crimped joint 8 for the purpose of providing a means of electrical connection. Most typically, wires 4 are mechanically 6 and/or electrically 8 connected to terminal tags 2 via soldering or crimping methods to provide a mechanical and electrical contact 6,8. As such, the terminal tags 2 are shaped, for example, at one end to mechanically 6 and electrically 8 receive and prevent the withdrawal of a wire 4, whilst further comprising a ring 10 or further means of electrical attachment at the opposing end for mechanical and electrical interaction with a terminal or connection point 12.

In use, the tag 2 ensures that the wire 4 is electrically connected to the connector and/or terminal via a mechanical means 10 which is of increased reliability over direct attachment of the wire 4. Thus, through insertion of the female portion 10 of the terminal tag 2 onto the male portion of the connector and/or terminal 12 followed by subsequent fixation, a reliable electrical contact may be established.

The inclusion of mechanically crimped parts 6 at the rear of each connector pair is often to provide a degree of support to the flexible wires 4, thus reducing stress and the likelihood of damage on the crimped electrical connectors 8. However, the inclusion of mechanically crimped parts 6 at the rear of each connector is often insufficient to prevent damage and ensure longevity of the tag 2.

Figure 2:
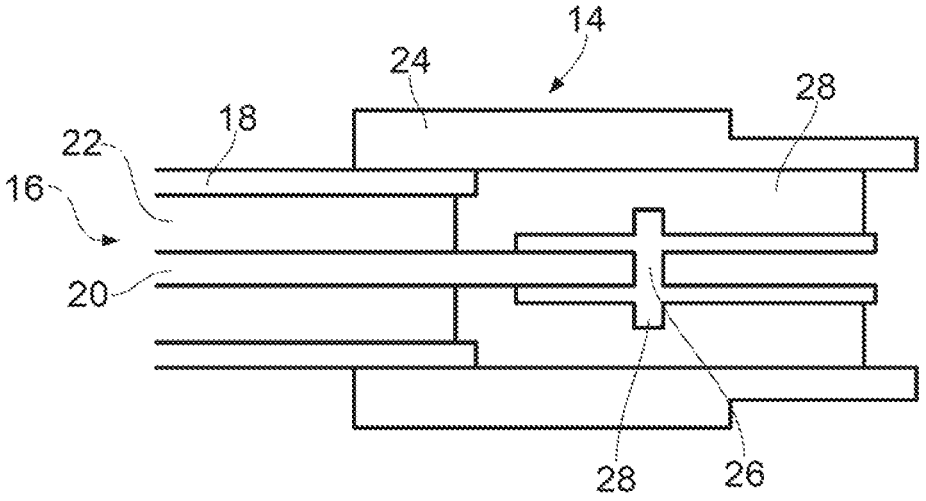
FIG. 2 (Prior Art)
FIG. 2 shows a cross-section through a pot seal.

FIG. 2 shows a cross section through a connector arrangement known as a Pot Seal 14 which is particularly suitable for the connection of minerally insulated (MI) cable 16. As shown in the example arrangement of FIG. 2, a single MI cable 16 is shown as being fed into a pot seal 14. Accordingly, the cable jacket 18 and conductor 20 is shown to be separated by an insulating portion 22, the jacket 18 being typically connected to the Pot 24 by soldering and the conductor 20 being typically connected to a pin or socket 26 by soldering or crimping. In particular, the pot seal casing 24 may be filled with an insulator 28, such as epoxy or glass, to electrically isolate the conductor 20 from the pot seal casing 24, whilst also fulfilling the function of orientating and positioning the conductor 20 for further engagement and/or connection. The further connection may be male or female in form—if female the further connection is referred to as a socket 26. If male the further connection is referred to as a pin, both of which may optionally include a shoulder 28 to grant improved mechanical integrity to the pin and/or socket 26.

Referring again to FIG. 2, FIG. 2 shows a female socket 26, the respective socket 26 and pin attachment members being designed to be connected or disconnected as matching pairs to form a connector. In an alternative embodiment, there may be two or more such connectors within a given pot seal 14 arrangement. In particular, if there is more than one connector 26 within the pot seal 14, it is necessary to orientate the two halves to ensure that matching male pin and female sockets 26 engage their respective portions. This would normally be achieved using, for example, a flat on the matching pots or alternate means of socket orientation to ensure that the pins and/or sockets 26 are correctly oriented before being bought into engagement.

Figure 3:
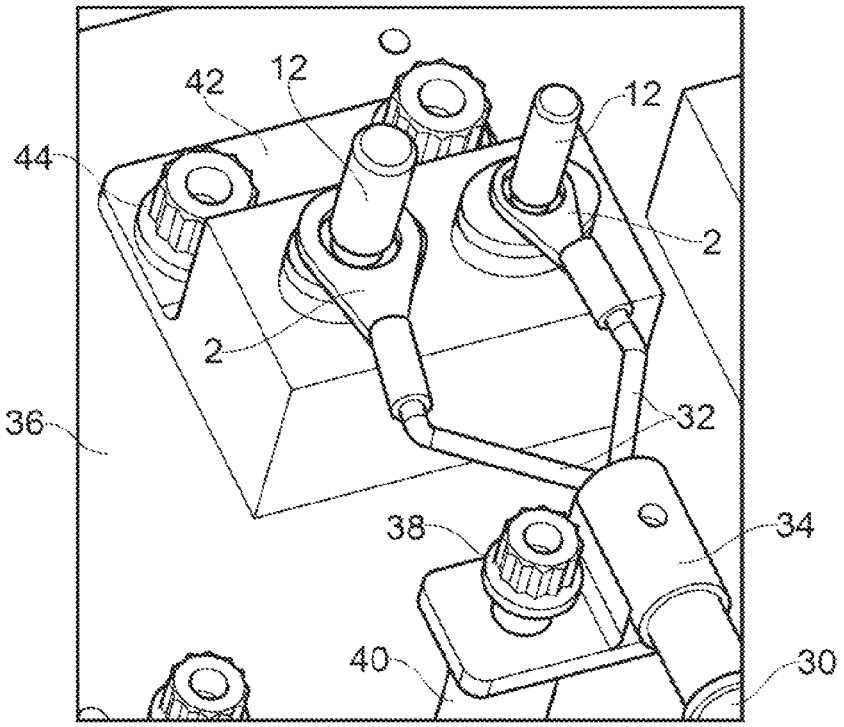
FIG. 3 (Prior Art)
FIG. 3 shows an isometric view of a terminal tag and pot seal as part of an assembled connector.

FIG. 3 shows an isometric view of a terminal tag 2 as part of a standard assembly. Accordingly, a single cable 30 comprising two or more wires 32 is shown to be fed through a supportive clip 34, the clip 34 being attached to a substrate 36 via a mechanical fastening means such as, for example, a bolt 38 and a threaded support member 40. As shown in FIG. 3, two wires 32 are shown to extend from the clip 34 and cable 30, although it will be appreciated that, in use, one wire 32, or multiple wires 32 may alternatively be used. Accordingly, each of the two wires 32 shown in FIG. 3 are connected to a terminal tag 2 via, for example, the connection method shown in FIG. 1. Additionally, each terminal tag 2 is shown to be connected to insulated connection studs 12 projecting from an insulated ceramic connector block 42, which is itself attached to the substrate 36 via a mechanical fastening means such as, for example, one or more bolts 38. In use, it will be appreciated that connection of the terminal tags 2 to the connecting studs 12 creates an electrical connection or termination such that an electrical circuit may be completed. It will also be appreciated that the terminal tags 2 may be held in place by an additional mechanical connector such as, for example, by a nut as part of a threaded stud and nut assembly.

In a further embodiment, the assembly may further comprise an insulating plate between the connecting studs 12 and the substrate 36 to provide further electrical and/or heat insulation therebetween. It may also be appreciated, in a further embodiment, that the insulated connection studs 12 are electrically connected to the substrate 36, or any further component as required.

Figure 4:
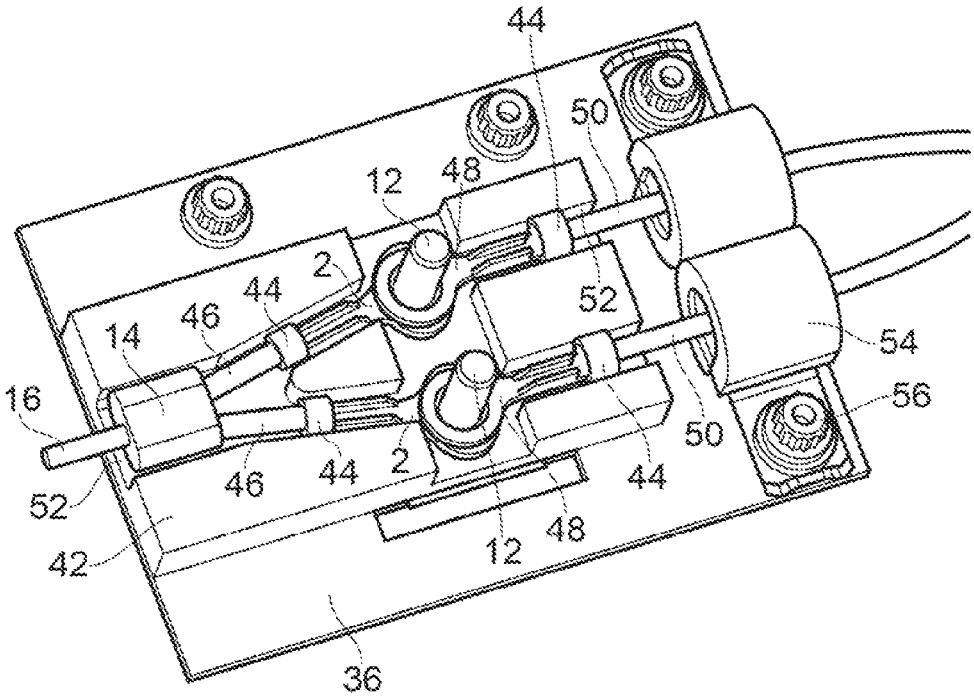
FIG. 4 shows an isometric view of the substrate and cable connection means.

FIG. 4 shows an isometric view of a substrate 36, an insulated ceramic connector block 42 at least partially protruding from a substrate 36 and a two insulated connecting studs 12 in accordance with the present disclosure, wherein singular or multiple MI cables are, in one embodiment, fed into one or more pot seals 14. In particular, whilst MI cable has been highlighted as a cable suitable for use in a preferred embodiment, it will also be appreciated that the arrangement may instead comprise insulated or non-insulated cable and/or wire, or any combination of the same.

Referring again to FIG. 4, a single MI cable 16 on the left of the figure is fed into a pot seal 14, as previously shown in FIG. 2. Thereafter, the one or more conductors 20 within the MI cable 16 may be split into one or more further conductors 46, which are thereafter shown to be connected via connection terminals 44 to one or more terminal tags 2. In the specific embodiment of FIG. 4, two conductors 46 are shown to protrude from the pot seal 14 and are terminated by two ring tags 2, or one ring tag 2 per conductor 20,46, although it will be appreciated that, in use, one or more conductors 20,46 may alternatively be used depending on the geometry and requirements of the MI cable 16 and/or pot seal 14, or the specific requirements of the user.

As shown in FIG. 4, each ring tag 2 is connected to a first terminal stud 12 which protrudes from, and is either electrically connected to, or is electrically insulated from the substrate 36. Also attached to the said terminal stud is a second ring tag 48 which connects to standard cable 50, although it will be appreciated that in a further embodiment, any such cable, including MI cable may also be used. FIG. 4 also shows the MI cable 16, pot seal 14, conductors 46, connection terminals 44, ring tags 2, terminal studs 12 and standard cables 50 being at least partially contained within an insulating block 42, the insulating block 42 comprising a series of shaped recessed channels 52 suitable for the at least partial containment of said components. In particular, variable sizing of the cable-retaining features or channels 52 may allow varying cable 16, conductor 46, connection terminal 44 and terminal tag 2 sizes to be accommodated within the insulating block 42 arrangement. Accordingly, the insulating block 42 is mounted on a radially outer region of the substrate 36, the terminal studs 12 being mounted within or alternatively through the insulating block 42 in order to insulate the components from the substrate 36. In particular, the insulating block 42 may be preferentially made of a rigid insulating material such as for example, a ceramic, but could be alternatively comprised of a composite, or either of an elastomeric or polymeric material. Referring once again to FIG. 4, the outgoing standard flexible cables 50 are further supported by standard supportive clips 54, the clip 54 being attached to the substrate 36 via a mechanical fastening means such as, for example, a bolt 56. The inclusion of supports 54 at either the entry or exit of the connector provides a degree of support to the flexible wires 16,50 thus reducing stress and the likelihood of damage, especially at the pot seal 14, electrical connectors 44 or ring tags 2,48.

Figure 5:
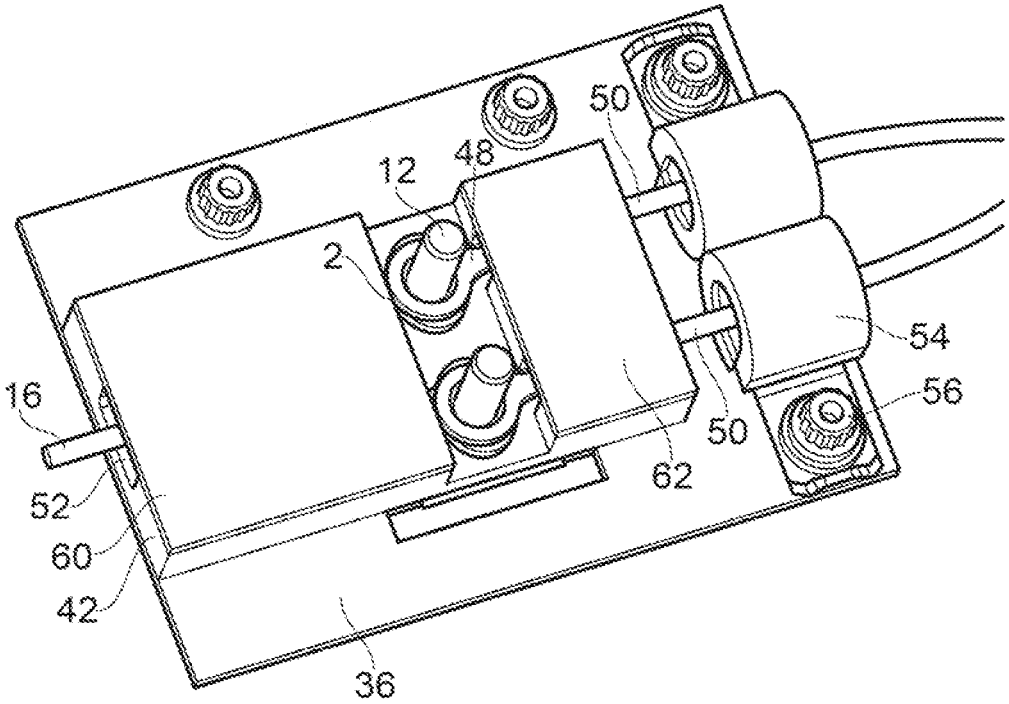
FIG. 5 shows an isometric view of the connector and ceramic felt.

FIG. 5 shows an isometric view of the connector previously described in FIG. 4, the connector additionally comprising a cover 60,62 to protect the MI cable 16, pot seal 14, conductors 46, electrical connectors 44, ring tags 2,48, terminal studs 12 or standard cables 50 during use. Accordingly, the cover 60,62 locates over the serious of shaped recessed channels 52 suitable for the at least partial containment of said components. In particular, the cover 60,62 may be preferentially made of a rigid insulating material such as for example, a ceramic or ceramic felt, but, in a further embodiment, could alternatively be comprised of a composite or either of an elastomeric or polymeric material. Accordingly, in a further embodiment, the cover 60,62 may vary in terms of specific shape, thickness or material depending upon the application, location, likelihood of damage and/or level of insulation required. In particular, FIG. 5 also shows a cover comprised of two individual sections 60,62, however it may also be envisioned that the two sections 60,62 be replaced by a single plate further comprising one or more enlarged recesses, which may be so shaped to access terminal studs 12 or ring tags 2,48, operable in use to allow access to the components for electrical checks. It will however be appreciated that in a further embodiment, any such recesses or holes may be included within the one or more covers 60,62 in order to access further contacts or electrical components as required.

Figure 6:
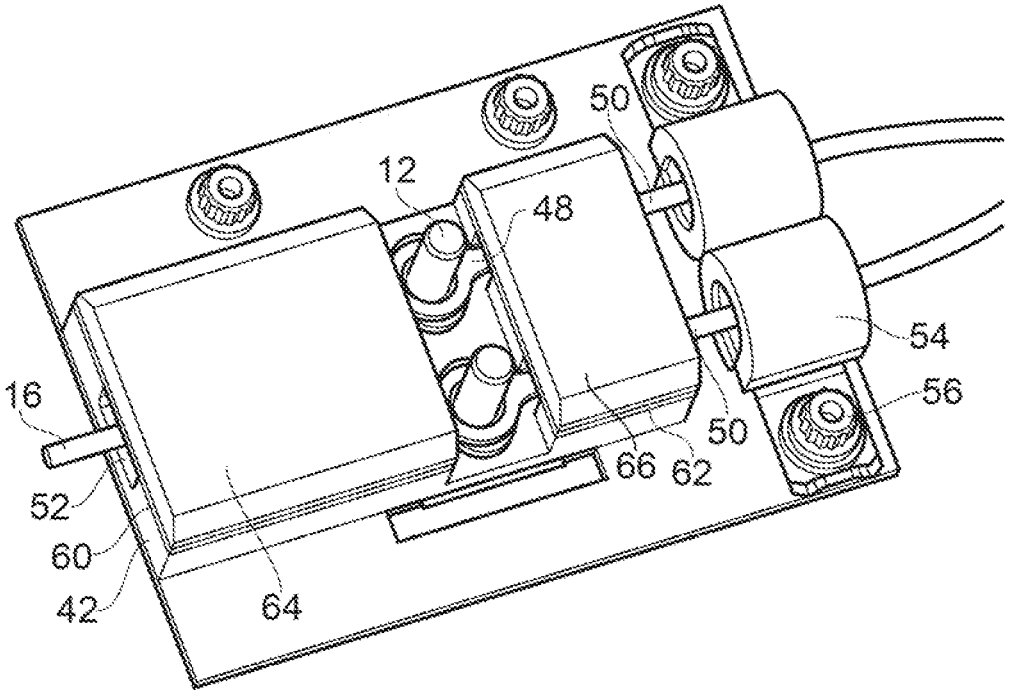
FIG. 6 shows an isometric view of the connector and protection means.

FIG. 6 shows an isometric view of the connector and cover arrangement previously described in FIG. 5, the arrangement comprising an additional protective cover 64,66 to protect the MI cable 16, pot seal 14, conductors 46, ring tags 2,48, terminal studs 12, standard cables 50 and cover 60,62 during use, in accordance with the present disclosure. Accordingly, the additional protective cover 64,66 locates over the cover 60,62 to provide additional containment, support and protection of the electrical components. In particular, the additional protective cover 64,66 may be preferentially made of a rigid insulating material such as for example, a ceramic or ceramic felt, but could alternatively be comprised of a composite or either of an elastomeric or polymeric material. Accordingly, the additional protective cover 64,66 may, in an alternative embodiment, be one or more of variable shape, thickness and/or material. In particular, FIG. 6 also shows an additional protective cover 64,66 comprised of two individual sections, however it may also be envisioned that the two sections 64,66 may be replaced by a single plate with an enlarged recesses, which may be so shaped to access terminal studs 12 or ring tags 2,48, operable in use to allow access to the components for electrical checks. It will however be appreciated that in a further embodiment, any such recesses or holes may be included within the one or more covers 64,66 in order to access specific contacts or electrical components.

Figure 7:
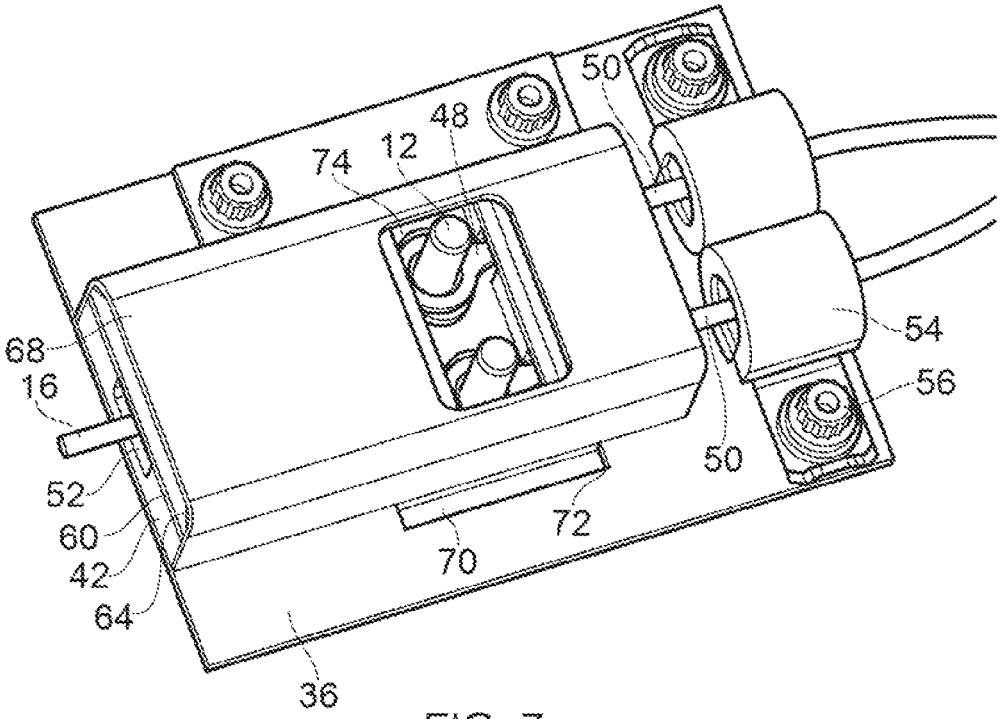
FIG. 7 shows an isometric view of the connector and lid.

FIG. 7 shows an isometric view of the connector previously described in FIG. 6, the connector additionally comprising a protective lid 68 in accordance with the present disclosure. In particular, FIG. 7 shows a lid 68 hingedly connected to the substrate 36 and operable in use to locate over the connector in order to locate against the additional protective cover 64,66. In particular, the embodiment shown in FIG. 7 provides a metal tang 70 bent at a right angle which fits into a slot 72 in the substrate 36, although it will be appreciated that in a further embodiment, the hinge formed by the tang and 70 and slot 72 may be replaced by any similar connecting, coupling or joining means. It will be appreciated that in the embodiment shown in FIG. 7, the protective lid 68 may be configured in use so as to apply a compressive load to the additional protective cover 64,66 in order to hold the connector together. It will be appreciated that in a further embodiment, the protective lid 68 may simply locate over the connector assembly, the assembly instead being held together by a mechanical or other such means of fastening such as, for example, a threaded screw or nut assembly. As shown in FIG. 7, the protective lid 68 is fastened to the substrate 36 via a hinge member provided on one side of the protective lid. The opposite side of the lid 68 is provided with a means of fixation to the substrate 36. As shown in FIG. 7, the means of fixation formed by the tang and 70 and slot 72 may, for example, include a plate comprising one or more holes, through which a bolt may be passed for mechanical attachment. However, it will be appreciated that the lid 68 may be connected to and tightened against the substrate 36 via cooperable screw threads, alternate joining means, or any such means of fixation.

In particular, the additional protective lid 68 may be preferentially made of a rigid insulating material such as for example, a ceramic or polymeric material, but could alternatively be comprise a metallic, composite, polymeric or elastomeric material. Accordingly, the additional protective lid 68 may, in an alternative embodiment, be one or more of variable shape, thickness and/or material. In particular, FIG. 7 also shows a protective lid 68 comprised of one single section, the section comprising an enlarged recess 74 which may be so shaped to access terminal studs 12 or ring tags 2,48, operable in use to allow access to the components for electrical checks. However it may also be envisioned that the single section 68 be replaced by two or more sections such that a recesses is provided. It will however be appreciated that in a further embodiment, any such recesses or hole may be included within the cover 68 in order to access specific contacts or electrical components.

Figure 8:
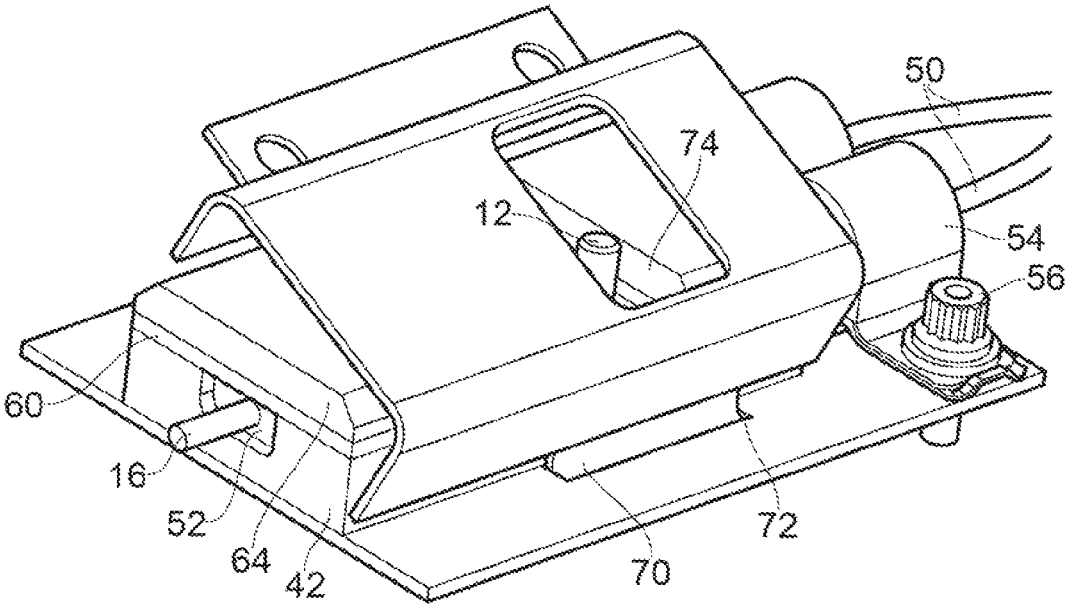
FIG. 8 shows an isometric view of the connector and a partially removed hinged lid, in accordance with the present disclosure.

FIG. 8 shows an isometric view of the connector and hinged lid 68 connected to the substrate 36 in accordance with the present disclosure and in accordance with the embodiment of FIG. 7. In particular, FIG. 8 shows MI cable 16 feeding into the connector, and standard cable 50 feeding out of the connector. However, it will be appreciated that in a further embodiment, the connector may be used to connect a MI cable 16 to a further MI cable 16, a standard cable 50 to a standard cable 50, or any such combination comprising any such further cable or wire known to exist within the art.

The invention claimed is:

1. An insulating connector for the connection of two or more cables or wires (16,50), the assembly comprising:

an electrically insulating block (42), said block (42) comprising:

one or more channels (52) to accommodate and support one or more inward cables (16), one or more of the inward cables comprising a minerally insulated cable;

one or more channels (52) to accommodate and support one or more outward cables (50);

one or more recesses (52) to accommodate one or more electrical components (14,2,48);

one or more terminal studs (12), each stud (12) arranged to connect said at least one inward and outward cable (16,50); and, a cover (60,62);

the cover (60, 62) comprising one or more protective plates (64,66) locatable over the electrically insulating block (42) and cables (16,50), the protective plates (64,66) further comprising one or more recesses located so as to provide access to each of the one or more terminal studs (12).

2. An assembly as claimed in claim 1 wherein one or more of the protective plates (64,66) are comprised of an electrically insulating material.

3. An assembly as claimed in claim 1 wherein one or more of the protective plates (64,66) are of increased toughness relative to the protective cover (60, 62) and/or electrically insulating block (42).

4. An assembly as claimed in claim 1 wherein one or more of the protective plates (64,66) additionally comprises a lid (68) which is fixedly attached to a substrate 36.

5. An assembly as claimed in claim 4 wherein the lid (68) comprises a recess or cavity (74).

6. An assembly as claimed in claim 5 wherein the recess or cavity (74) is placed so as to allow access to each of the one or more terminal studs (12).

7. An assembly as claimed in claim 1 wherein said inward or outward cable (16,50) is bifurcated within a pot seal (14), said pot seal (14) being contained within a recess (52) formed within the electrically insulating block (42).

8. An assembly as claimed in claim 7 wherein said inward or outward cable (16, 50) is thereon connected to one or more inward or outward conductors (46) protruding from said pot seal (14).

9. An assembly as claimed in claim 8 wherein said inward or outward conductors (46) are connected to said one or more terminal studs (12) by one or more connection terminals (44).

10. An assembly as claimed in claim 9 wherein said connection terminals (44) are comprised of ring tags (2,48), said ring tags (2,48) being arranged so that they may locate, in use, on respective terminal studs (12).

11. An assembly as claimed in claim 1 wherein the width of each channel (52) comprised within the insulating block (42) is approximately equal to or greater than the diameter of the cable (16,50) to be located, in use, in each respective channel (52).

12. An assembly as claimed in claim 1 wherein the width of each recess (52) comprised within the insulating block (42) varies to accommodate, in use, the respective pot seals (14), conductors (46), connection terminals (44) and ring tag (2,48) components.

13. An assembly as claimed in claim 1 wherein said one or more inward cables (16) are supported before entry into the assembly by a cable location and support feature.

14. An assembly as claimed in claim 1 wherein said one or more outward cables (50) are supported following exit from the assembly by one or more cable location and support features (54).

15. An assembly as claimed in claim 1 wherein the electrically insulating block (42) comprises at least a sufficient number of channels and/or recesses (52) to accommodate, in use, each cable (50) and electrical component (2,14,44,46,48).

* * * * *